US005181855A

United States Patent [19]

Mosquera et al.

[11] Patent Number: 5,181,855

[45] Date of Patent: Jan. 26, 1993

[54] SIMPLIFIED CONTACT CONNECTOR SYSTEM

[75] Inventors: Rene A. Mosquera, Laguna Niguel; Michael A. Lin, Anaheim, both of Calif.

[73] Assignee: ITT Corporation, Secaucus, N.J.

[21] Appl. No.: 899,581

[22] Filed: Jun. 18, 1992

Related U.S. Application Data

[63] Continuation of Ser. No. 771,276, Oct. 3, 1991, abandoned.

[51] Int. Cl.[5] ..... H01R 13/00

[52] U.S. Cl. ..... 439/74; 439/291

[58] Field of Search ..... 439/74, 284, 290, 291, 439/295

[56] References Cited

U.S. PATENT DOCUMENTS

| | | | |
|---|---|---|---|
| 2,977,562 | 12/1954 | Benson | 339/17 |
| 3,070,769 | 12/1962 | Murphy | 439/291 |
| 3,091,746 | 5/1963 | Winkler | 439/295 |
| 3,234,433 | 2/1966 | Braunagel | 317/101 |
| 3,329,925 | 7/1967 | Johnson et al. | 339/91 |
| 3,337,836 | 8/1967 | Churla, Jr. | 339/49 |
| 3,340,439 | 9/1967 | Henschen et al. | 317/101 |
| 3,663,931 | 5/1972 | Brown | 339/218 |
| 3,868,162 | 2/1975 | Ammon | 339/17 |
| 4,089,104 | 5/1978 | Barry et al. | 29/626 |
| 4,133,592 | 1/1979 | Cobaugh et al. | 339/17 |
| 4,286,837 | 9/1981 | Yasutake et al. | 339/176 |
| 4,316,321 | 2/1982 | Wickham | 29/845 |
| 4,332,431 | 6/1982 | Bobb et al. | 339/74 |
| 4,482,937 | 11/1984 | Berg | 361/413 |
| 4,501,460 | 2/1985 | Sisler | 339/49 |
| 4,619,495 | 10/1986 | Sochor | 339/176 |
| 4,680,674 | 7/1987 | Moore | 361/395 |
| 4,686,607 | 8/1987 | Johnson | 361/413 |
| 4,733,461 | 3/1988 | Nakano | 29/830 |
| 4,734,060 | 3/1988 | Kawawada et al. | 439/660 |
| 4,808,115 | 2/1989 | Norton et al. | 439/79 |
| 4,904,212 | 2/1990 | Durbin et al. | 439/751 |
| 4,939,624 | 7/1990 | August et al. | 361/424 |
| 4,950,170 | 8/1990 | Miller, Jr. | 439/74 |
| 4,959,024 | 9/1990 | Czeschika | 439/607 |
| 5,098,311 | 3/1992 | Roath et al. | 439/290 |

FOREIGN PATENT DOCUMENTS

| | | |
|---|---|---|
| 207069 | 10/1979 | Fed. Rep. of Germany . |
| 902464 | 8/1962 | United Kingdom . |

*Primary Examiner*—Joseph H. McGlynn
*Attorney, Agent, or Firm*—Thomas L. Peterson

[57] ABSTRACT

A connector system is provided that is especially useful for SCEM (small computer expandability module) systems wherein small circuit boards or "tiles" can be stacked at different positions on a small mother board, wherein each connector includes numerous very small matable contacts that must carry high frequency signals. The contacts of first and second matable connectors each have forward portions (80, FIG. 6) comprising an elongated beam (132) having a straight rear part (140) extending parallel to the mating direction (114) and having a forward part (144) with a sidewardly-projecting protuberance (146). When the connectors are mated, the protuberance of each contact engages the straight rear part of the other contact. Each connector housing includes an insulator with an upstanding support wall (91) having a plurality of grooves (122) spaced along a row of contacts, with each groove surrounding the axis (142) of each contact on three sides, except for the contact protuberance. When the connectors are mated, each support wall is inserted into a slot lying between a pair of support walls of the other connector. Where connectors are required at opposite faces of a circuit board, each contact has a mount portion lying in a plated-through hole of the circuit board, and has substantially identical opposite end portions that each include a beam with a protuberance.

17 Claims, 8 Drawing Sheets

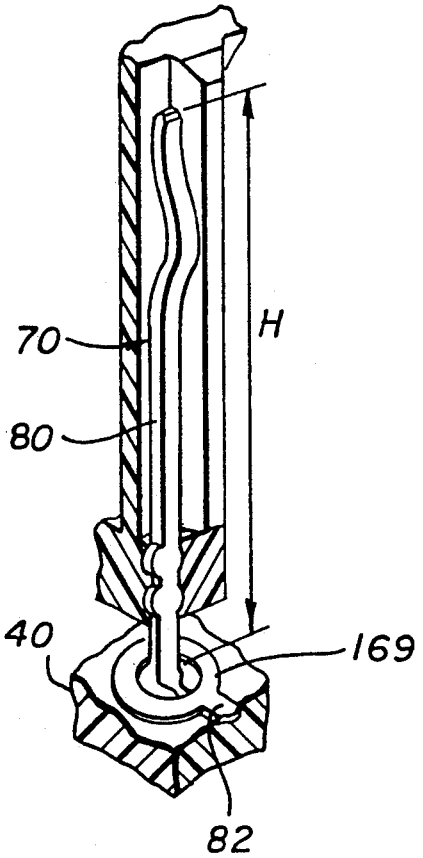
FIG. 8
FIG. 10
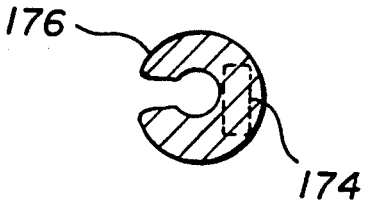
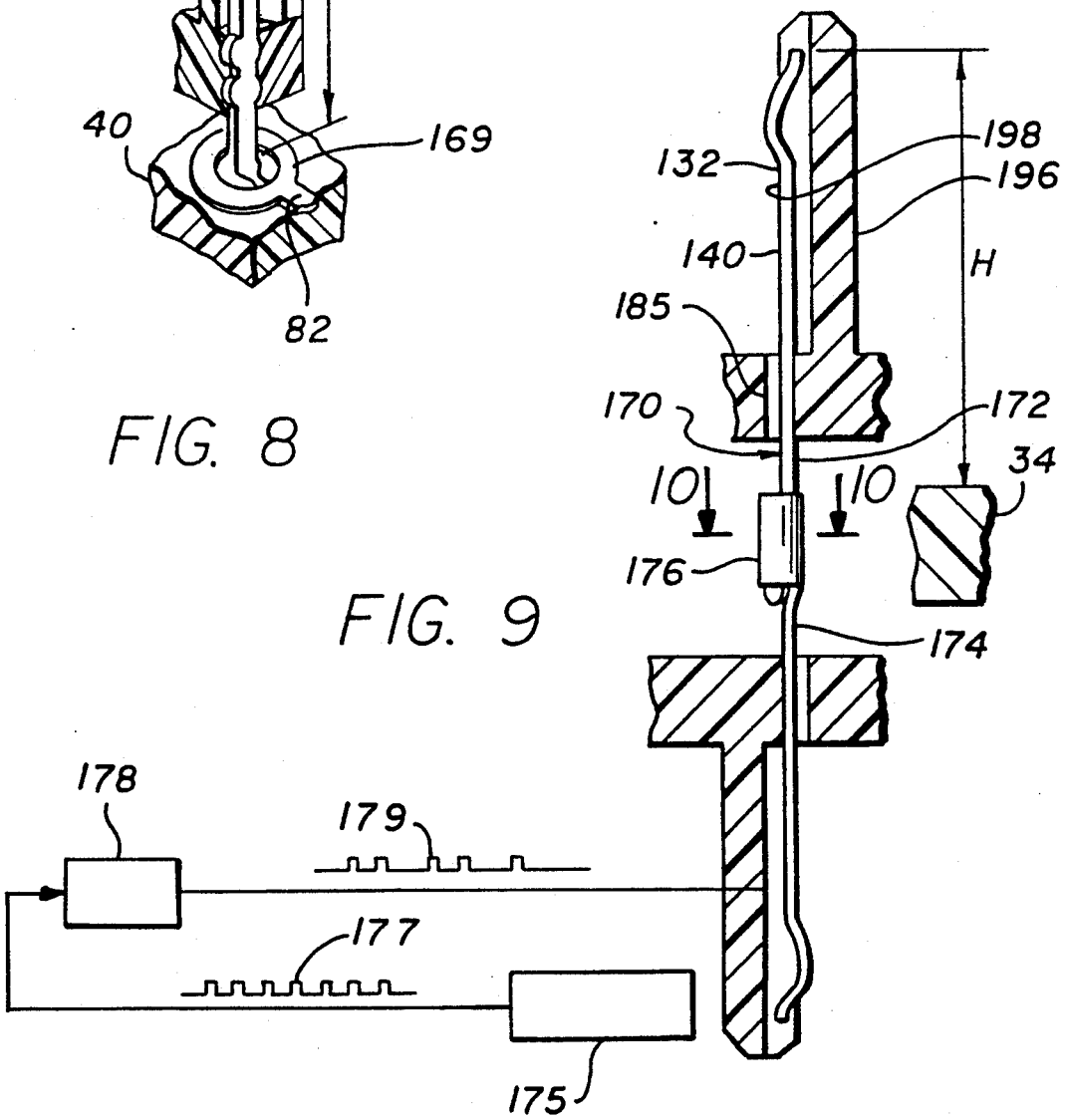
FIG. 9

FIG. 12
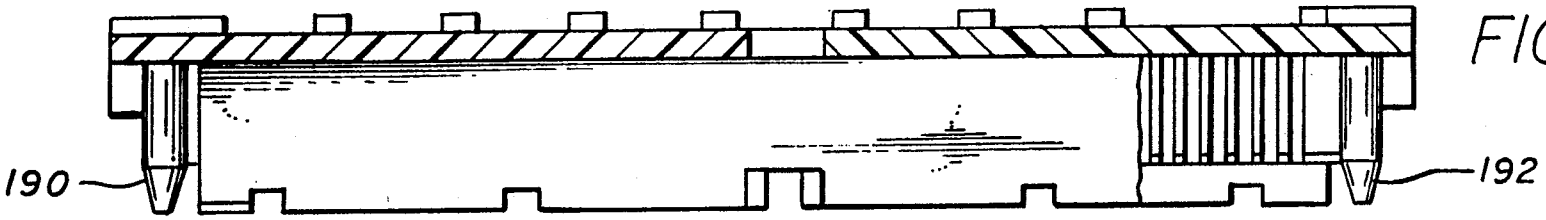
FIG. 13
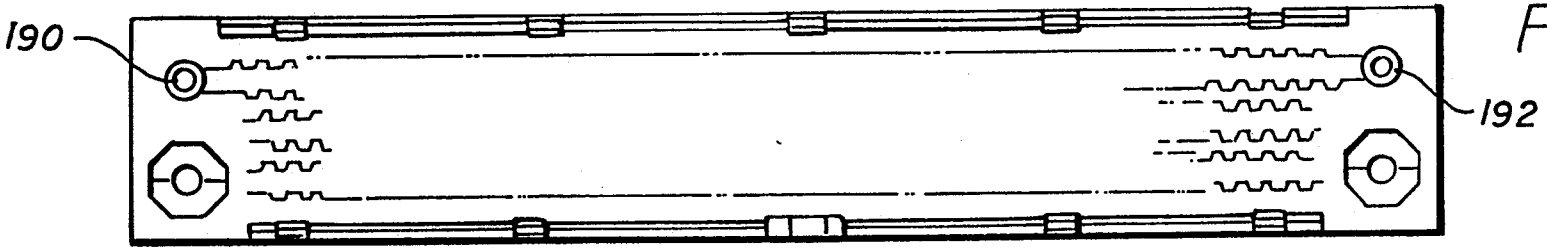
FIG. 16
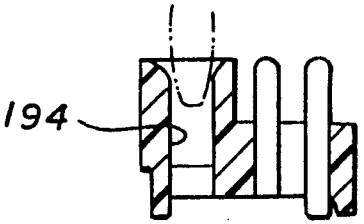
FIG. 15
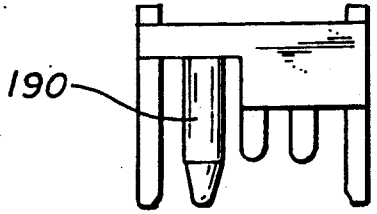
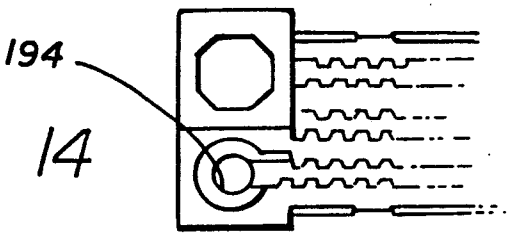
FIG. 14

SIMPLIFIED CONTACT CONNECTOR SYSTEM

This is a continuation of application Ser. No. 07/771,276 filed Oct. 3, 1991, now abandoned.

BACKGROUND OF THE INVENTION

SCEM (small computer expandability module) is a type of architecture for small computers wherein various small modules, often in the form of small circuit boards or "tiles", can be stacked at any of several selected positions on a mother board. One architecture uses modules of a width and length of about six centimeters and nine centimeters respectively, with each connector having between 250 and 700 contacts arranged in between five and ten rows. As a result, the contacts must be spaced apart along each row by about one millimeter or less, necessitating the use of very small contacts. Of course, each of the numerous contacts of a connector must be well protected against damage and must reliably mate with corresponding contacts of another connector. A connector with contacts that were of very small size but which were reliably protected and which reliably mated with corresponding contacts, and which could be constructed at low cost, would be of considerable value.

SUMMARY OF THE INVENTION

In accordance with one embodiment of the present invention, a connector system is provided which includes connectors with matable contacts, wherein the contacts are of simple shape for low cost precision manufacture in very small sizes, and yet can reliably mate and are well protected. Each contact of two matable connectors, has a forward end portion with an elongated beam. The beam has a straight rear part extending parallel to the mating direction and a forward part with a protuberance projecting sidewardly. The extreme side of the protuberance forms a mating location which substantially engages the straight rear part of a corresponding mating contact.

Each connector has an insulator with support walls, including a first support wall extending along the length of a first row of contacts. The first support wall has a plurality of grooves extending along the mating direction, with the beam portion of each contact of a first row lying in one of the grooves. Each groove has groove sides surrounding the axis of the beam on three sides, with only the protuberance projecting from the open side of the groove. Each connector has a plurality of support walls with contact-holding grooves and forms a slot between a pair of supporting walls. A pair of connectors is constructed so as they mate, a supporting wall of one connector fits in close slidable movement into the slot between a pair of support walls of the other connector.

Where the contact forward end portions project from a surface of a circuit board, and the contact carries pulses having a predetermined clock rate of at least fifty million per second (which can generate a fundamental frequency of 50 MHz), the length of each contact outer portion equals the wavelength of the fundamental frequency divided by $2^n$, where n is a whole number.

A pair of mating connectors are constructed so one has at least one aligning or locating pin and the other has a pin-receiving hole that closely receives the locating pin. Both the locating pin and walls of the pin-receiving hole are molded integrally with the insulator that has slots surrounding a multiplicity of contacts.

The novel features of the invention are set forth with particularity in the appended claims. The invention will be best understood from the following description when read in conjunction with the accompanying drawings.

BRIEF DESCRIPTION OF THE DRAWINGS

FIG. 8 is a partial isometric view of the connector of FIG. 6.

FIG. 9 is a partial sectional view of one of the connectors of FIG. 2, and also showing a pulse generator coupled thereto.

FIG. 10 is a view taken on the line 10—10 of FIG. 9.

FIG. 12 is a sectional side view of one of the connectors of FIG. 3.

FIG. 13 is a bottom view of the connector of FIG. 12.

FIG. 14 is a partial top view of another connector which the connector of FIG. 15 mates with.

FIG. 15 is an end view of the connector of FIG. 12.

FIG. 16 is an end view of the connector of FIG. 14.

DESCRIPTION OF THE PREFERRED EMBODIMENTS

Figure 1:
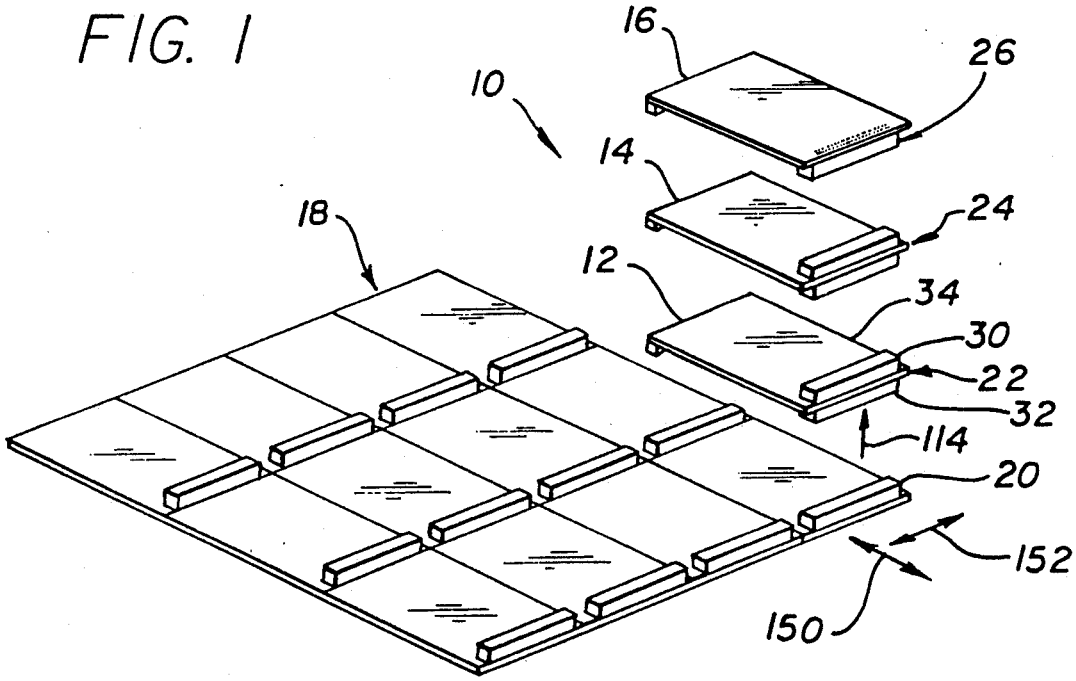
FIG. 1 is an exploded isometric view of a connector system for connecting modules of an expandable module system.
Figure 4:
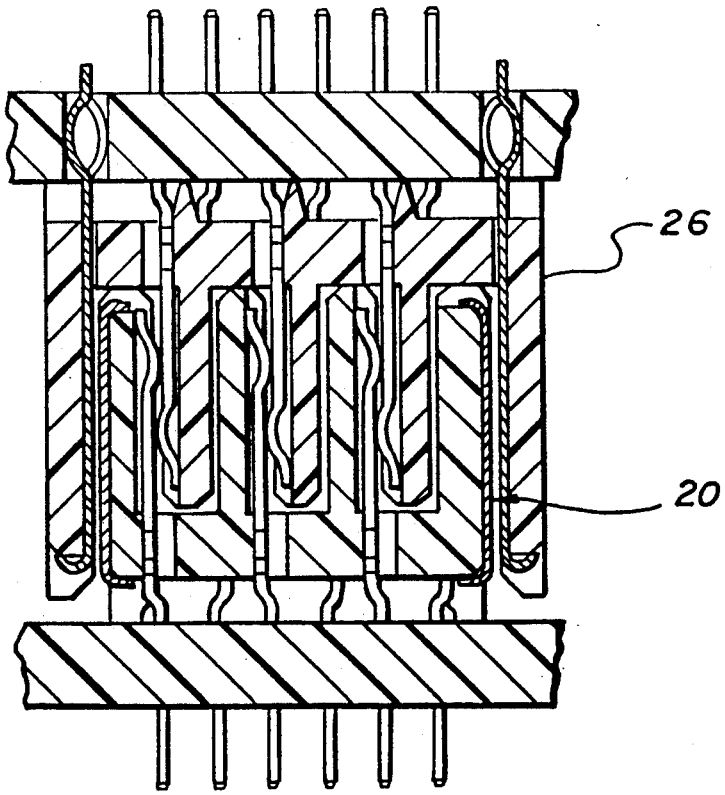
FIG. 4 is a sectional view of the connectors of FIG. 3 and of circuit boards that they mount on, shown in a fully mated position.
Figure 2:
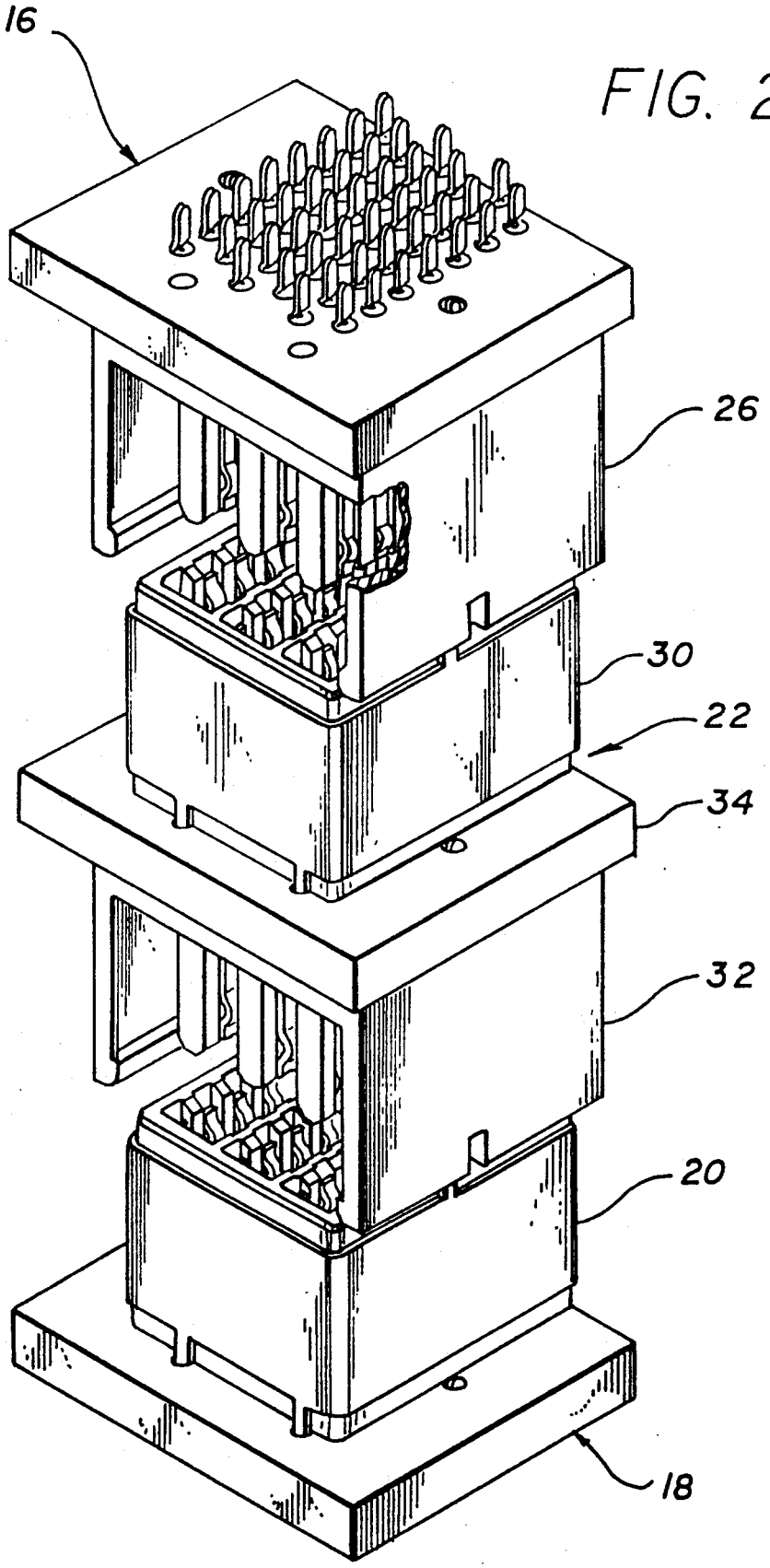
FIG. 2 is a partial isometric view of the system of FIG. 1, with three boards and associated connectors.
Figure 3:
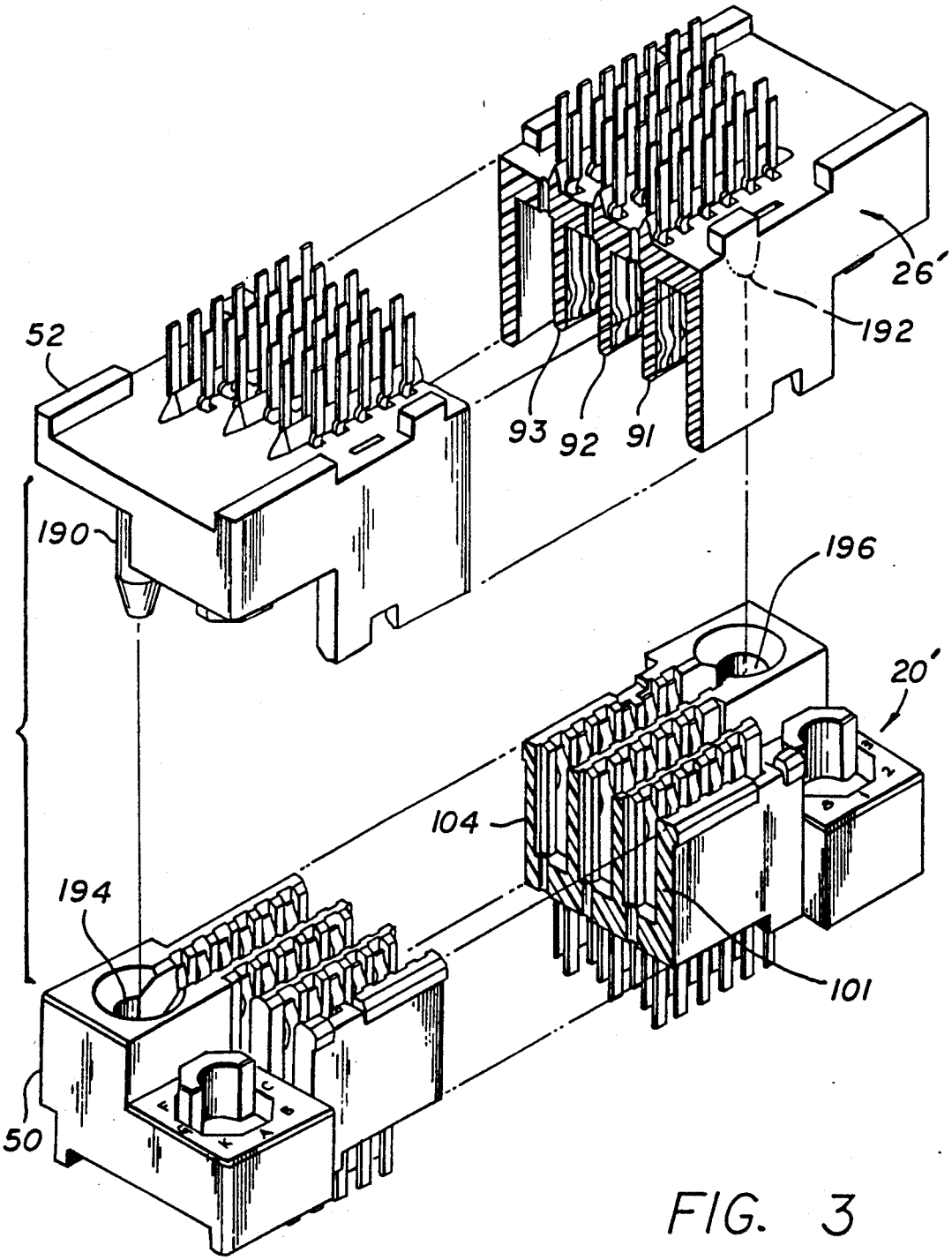
FIG. 3 is a sectional, exploded isometric view of two connectors of the system of FIG. 2, but without showing the circuit boards connected thereto and with the connectors in FIG. 3 being modified to have locating pins or pin-receiving recesses at their end.

FIG. 1 illustrates a connector system 10 for connecting various modules 12, 14, 16 to each other and to a mother board 18 (which may sometimes be referred to as a module). This type of architecture has been designed for small computers to allow modules to expand the capability of the computer. Although most modules are small circuit boards or "tiles", other modules such as a floppy disc module can be used. The particular mother board shown has twelve different positions on which a module can be stacked, with a mother board connector 20 at each of the twelve positions. Each module 12–16 includes a module connector 22–26 for interconnecting the modules to each other and to the mother board. Each of the middle module connectors 22, 24 includes upper and lower parts 30, 32 at opposite faces of the module, which usually comprises a small circuit board 34. Of course terms such as "upper" and "lower" are only used to aid in the description, and the system can be used in any orientation with respect to gravity. Each of the end connectors 20, 26 has a connector part on only one side of the circuit board or module. FIG. 2 shows an arrangement which includes only the mother board 18 and two of the modules 12, 16. FIG. 3 illustrates an arrangement where only the connectors 20, 26 of the lowermost (mother board) and uppermost modules are arranged to be connected. Any of the above arrangements and more complex ones can be used.

Figure 5:
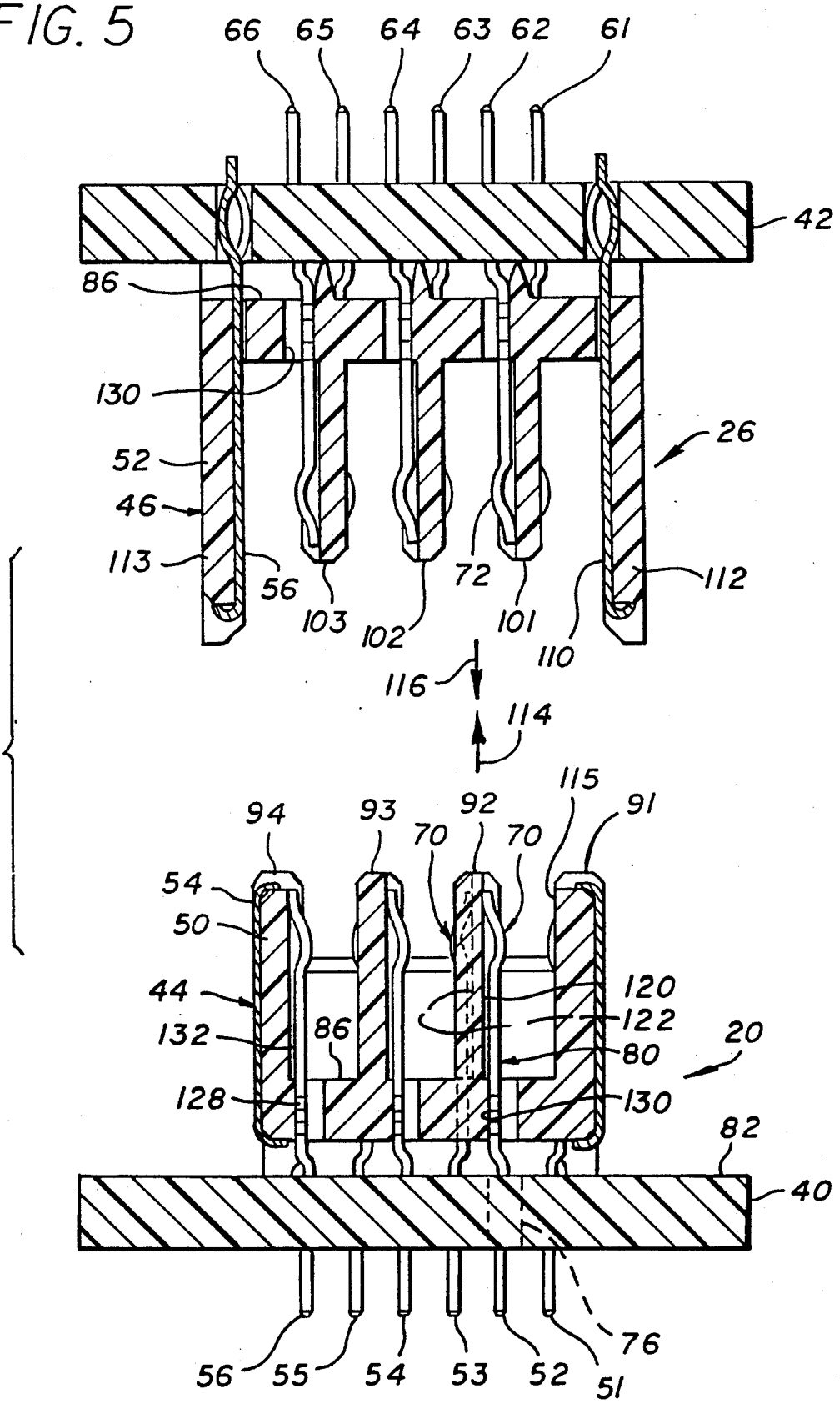
FIG. 5 is an exploded view of the system of FIG. 4, but showing the connectors unmated.

FIG. 5 illustrates the two connectors 20, 26 which are mounted on corresponding boards including the mother board circuit board 40 and the module board 42. Each connector includes a housing 44, 46 that comprises an insulator 50, 52 and a grounded metal shell 54, 56. Each connector also includes six rows of contacts, including rows 51–56 of the connector 20 and rows 61–66 of the connector 26. Each row of the connector 20 has a large number of spaced contacts 70, and the other connector 26 also has a large number of spaced contacts 72 in each row.

Each contact has a mount part 76 which is mounted in the corresponding board such as 40 and a mating or forward end portion 80 projecting from a face 82 of the board. Each insulator such as 50 includes a base 86 and upstanding walls including contact-support walls, the connector 20 having four support walls 91–94 and the other connector 26 having three support walls 101–103. The connector 26 forms four slots 110 between pairs of adjacent support walls, and between them and opposite insulator side walls 112, 113. The connector 20 forms three slots 115 between its support walls. Each of the four slots 110 in the connector 26 closely receives one of the four support walls 91–94 of the other connector 20 during mating of the connectors. Such mating occurs when each connector is moved in a corresponding forward or mating direction 114, 116 towards the other connector.

Each of the support walls such as 92 includes two rows of grooves 120, 122 located on opposite sides of the support wall, with the grooves on the two sides staggered from one another. Each insulator base 86 has a hole 130 with a portion aligned with a groove, for receiving a part 128 of each contact forward end portion 80. Each contact also has an elongated beam 132 which extends in the corresponding forward or mating direction 114 along the groove.

Figure 6:
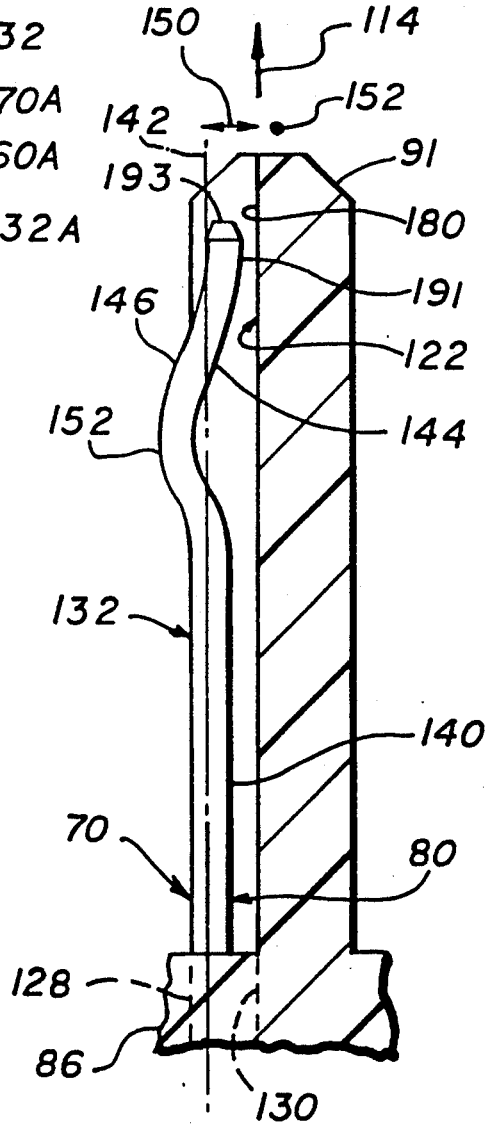
FIG. 6 is an enlarged view of a portion of one of the connectors of FIG. 5.

As shown in FIG. 6, the beam 132 of the contact outer portion 80 includes a straight rear part 140 extending along a contact axis 142, which is substantially parallel with the forward or mating direction 114 and preferably within about 3° of parallelism. The beam 132 also includes a forward part 144 with a protuberance 146 projecting sidewardly along the direction 150. The lateral or sideward direction 150 is perpendicular to a longitudinal direction 152 along which each row extends, and also is perpendicular to the mating or forward direction 114. The extreme side 152 of the protuberance forms a mating location which is designed to engage the straight rearward part of another contact.

Figure 7:
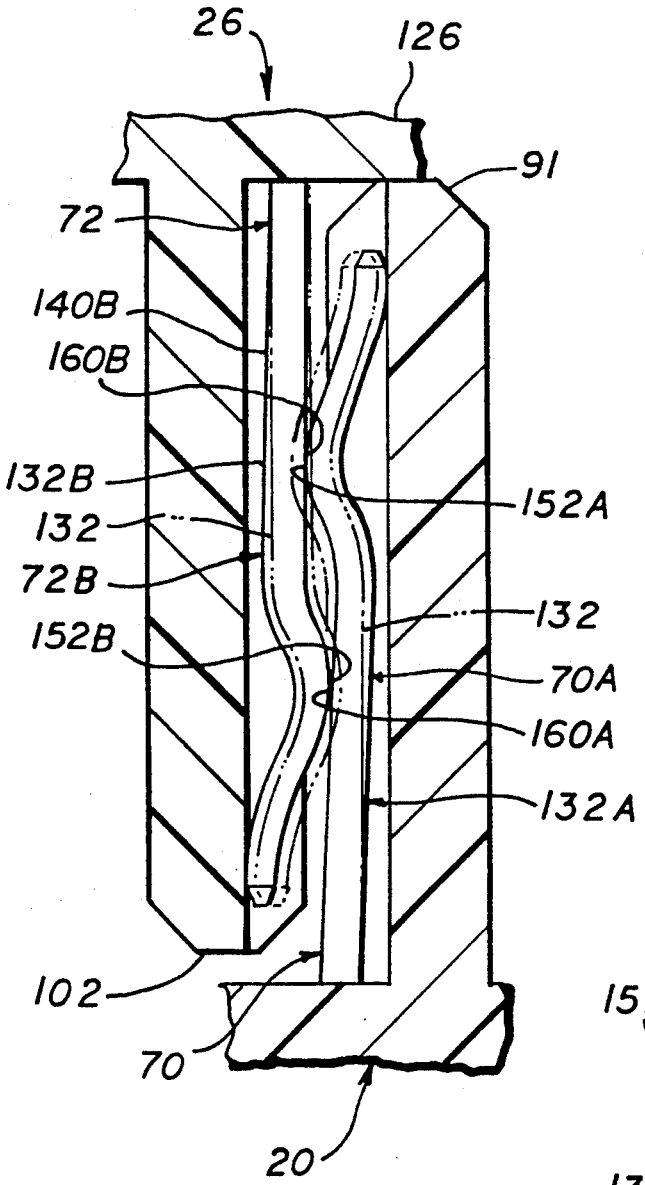
FIG. 7 is an enlarged partial sectional view of the pair of connectors of FIG. 5, shown in a fully mated position, and also showing in phantom lines, the connector contacts in their unmated positions.

FIG. 7 illustrates the situation where the two connectors 20, 26 have been fully mated, showing the relative positions of their contacts in the mated positions at 70A and 72B. It can be seen that the beams 132A, 132B have been deflected by about 2° from their initial positions 132 that are indicated in phantom lines. If the contacts are properly constructed and mounted, then the extreme outer side 152A of the contact 70 will engage a second mating location 160B along the rear part 140B of the contact 72. Similarly, the extreme outer side 152B of the contact 172 will engage a second contact location 160A on the contact 70. The presence of two contact locations increases the reliability of electrical engagement of the two connectors. The fact that both contacts 70, 72 are identical, and all contacts in the system have substantially identical forward end portions, enables low cost manufacture. Also, the use of contacts with identical forward end portions provides a hermaphroditic arrangement where the contacts of any connector can properly mate with the contacts of any other connector, it only being necessary that the housings be matable.

An additional benefit of the contact shape used, is that it minimizes signal degradation when signals with high frequency components pass through the mating contacts. That is, it minimizes any increase in rise and fall times of pulses. When high frequency signals pass through a contact, the contact radiates some of the signal power. The radiated power emitted from the beam at 132A will be reflected by the facewise adjacent portions of the beam 132B of the other contact and the reflections between the two contacts will slow the signal (increase rise and fall times of pulses). However, only one side of each contact faces the mating contact, so most of the power radiated from the contact does not reach the adjacent contact but instead much of it is absorbed by the adjacent insulation and/or radiated into space. This can be contrasted with those connector systems which use pin contacts that are inserted into socket contacts, where the socket contact surrounds the pin contact on all sides (360°), except for thin slots. In that case, considerable energy reflected from the pin contact will be reflected back and forth between it and the socket contact so there will be more slowing of the signal. Thus, the construction of the hermaphroditic contacts with simple beams that mate, minimizes the degradation of high frequency signals.

As shown in FIG. 8, the forward end portion 80 of the contact 70 has a height H above the corresponding face 82 of the circuit board (above a conductive trace 169 on the board, where the board forms a ground plane). If the height H can be matched to the wave length of the fundamental frequency of high frequency signals passing through the contact, then radiation reflection from the end portion 80 is minimized, which reduces degradation (minimizes any increase in rise and fall times) of signals passing through the contacts. For a given fundamental frequency f whose wave length is λ, radiation reflection from the contact is minimized by using the following length for the contact forward end portion:

$$H = \frac{\lambda}{2^n} = \frac{c}{f \cdot 2^n}$$

where H is the length of the contact forward portion that projects from the circuit board, λ is the wave length of the fundamental frequency whose radiation is to be minimized, f is the frequency of that fundamental frequency, c is the speed of light, and n is a whole number which is generally no more than 10, and usually in the range of 6 to 9. Thus, if the fundamental frequency to be transmitted is 300 MHz, so the wave length is one meter, then if n =8, the length H of the contact will be $$H = 1 \text{ meter} / 2^8 = 4 \text{ millimeters}$$

If n equals 9, then H equals 2 millimeters. In a computer with a clock rate R of 300 million clocks per second, the fundamental frequency is 300 MHz and a contact forward end portion of length H such as 4 mm (plus or minus five per cent and preferably within three per cent) will significantly reduce signal degradation.

FIG. 9 shows a clock 175 whose output 177 comprises a series of pulses generated at a clock rate R of 300 million pulses per second, so the pulses are spaced by 3.33 nanoseconds apart. The output of the clock controls a circuit 178 such as a memory or microprocessor whose output 179 includes pulses spaced apart by a multiple (1, 2, 3 etc.) of 3.33 nanoseconds, so it produces a fundamental frequency of 300 MHz. As mentioned above, close control of the projecting contact outer end portion of length H can minimize signal degradation.

Some connectors have upper and lower connector parts, such as connector 22 of FIG. 2 which has upper and lower connector parts 30, 32. FIG. 9 shows the shape of one of the contacts 170 which has opposite forward end portions 172, 174 projecting from opposite ends of a mount part 176. The mount part 176 lies in a plated-through hole of the circuit board 34. FIG. 10 illustrates the shape of the mount part 176, which is C-shaped to make a compliant fit in the circuit board hole and to hold itself in a predetermined orientation within the hole. Where only one contact part must extend from only one face of a circuit board or other module, the other portion that projects from the opposite board face can be of short length, so it provides only short tabs which can be accessed for testing.

Figure 11A:
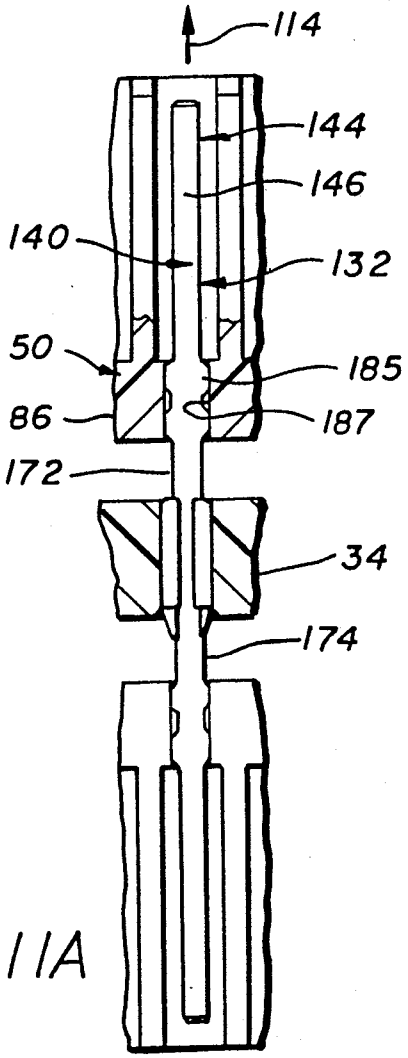
FIG. 11A is a partially sectional view taken perpendicular to the view of FIG. 9.
Figure 11:
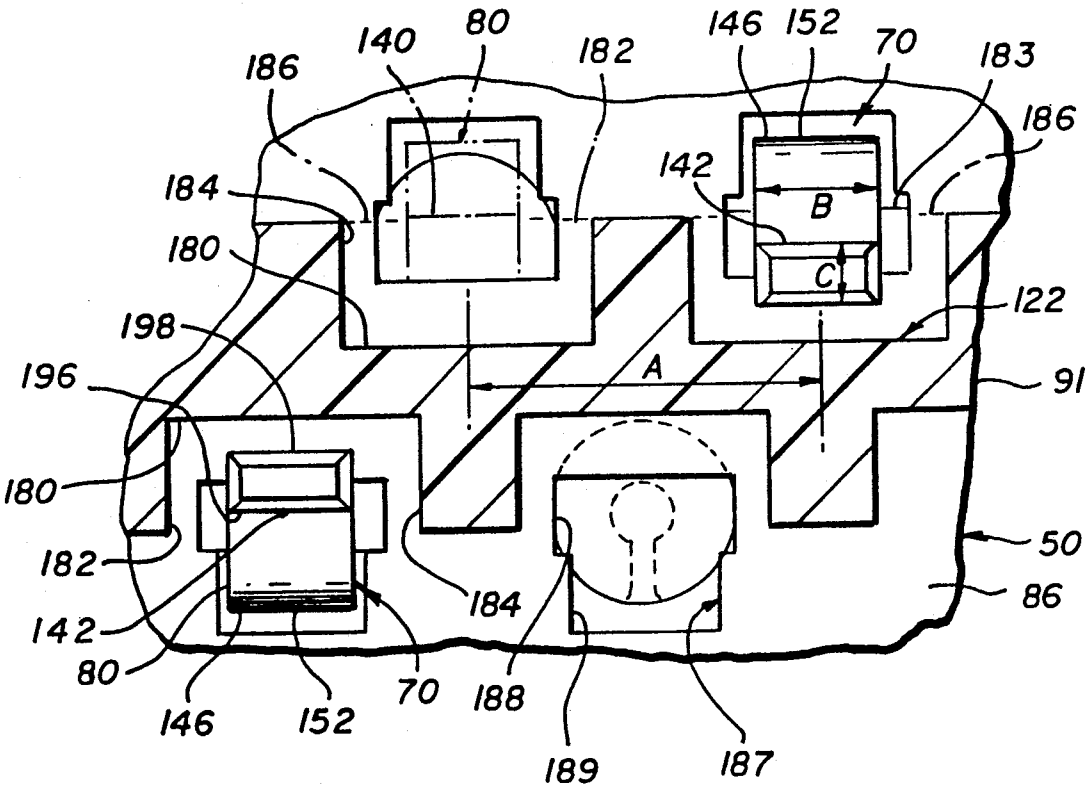
FIG. 11 is a partial plan view of the connector of FIG. 9.

As shown in FIG. 11, each contact end portion such as 80 (corresponding to the contact 70 of FIG. 6) has an axis 142 which is surrounded on three sides by sides 180–184 of the groove 122. The outer side 183 of the contact lies substantially flush with the outer side of the groove at 186. Of course, the extreme side 152 of the protuberance 146 projects beyond the groove, that is, beyond an imaginary line 186 at the opening of the groove 122. This assures very good protection for the contact by the support wall 91 which has the grooves.

Each contact has a base-received part 185 (FIG. IIA) which lies in interference fit with a somewhat T-shaped slot 187 in the base 86 of the insulator 50. The walls of the wide part 188 of the slot keep the beam 132 of the contact forward end portion 80 at a constant orientation wherein the rear beam part 140 extends in the forward or mating direction 114. The slot has a narrower portion 189 for passing the beam protuberance 146 during installation.

Applicant prefers to make the entire rear part of the beam 132 straight (as seen in both views of FIGS. 9 and 11A), because any bending introduces tolerances, and only very small tolerances are acceptable with such small contacts. As shown in FIG. 9, the base-received part 185 and rear beam part 140 preferably have face portions (of faces 196, 198) that are coplanar to avoid the accumlation of tolerances that would result from a bend.

As mentioned above, the outer side 183 of the entire beam 132, except for the protuberance 146, preferably lies substantially flush with the outer side 186 of the groove. If the beam axis projected beyond the outer side of the groove it could be damaged, while if it lay deep in the groove this would increase the required groove depth and increase the connector size.

The tip region 191 (FIG. 6) preferably extends parallel to the rear part 140 and to the bottom wall 180 of the groove. It is easier to bend the contact so the tip region 191 extends in the forward or mating direction and is spaced a known distance from the groove bottom wall, than to try to have the extreme tip 193 accurately engage the groove bottom wall.

Referring to FIG. 3, the connector 261 has locating pins 190, 192 at its opposite ends, while the connector 201 has pin-receiving recesses 194, 196 at its opposite ends that very closely receive the locating pins. Of course, the purpose of the locating pins is to assure that the multiple grooves of the two contacts are accurately aligned during mating. Applicant forms each of the insulators 50, 52 as a one-piece molded member, with the locating pins 190, 192 and the walls of the pin-receiving holes 194, 196 each being molded integrally with the support walls such as 101–104 of contact 201 and the support walls 91–93 of the connector 26 each being molded integrally with its corresponding locating part (walls of pin-receiving hole). That is, insulator 52 is molded so the locating pins such as 190 are integral with the corresponding support walls 91–93.

Applicant has designed connectors of the type illustrated, with the centers of adjacent contacts being spaced apart by a distance A (FIG. 11) of one millimeter. Each contact was constructed of sheet metal, with the beam of each contact having a width B of 0.38 mm and a thickness C of 0.15 mm, the contacts being constructed of phosphor bronze. Each beam has opposite flat faces 196, 198. As illustrated, each connector has six rows of contacts, with between sixty six and sixty eight contacts per row to provide a total of four hundred contacts in a connector of a length of about 2.6 inches (6.6 cm) and width of about 0.36 inch (0.9 cm).

Thus, the invention provides a connector system which is especially useful in small connectors having large numbers of contacts such as are used in small computer expandability module systems. Each connector system includes first and second matable connectors, wherein each contact of each connector has a forward end portion in the form of an elongated beam having a straight rear part extending parallel to the mating direction and having a forward part with a protuberance projecting sidewardly. The extreme side of the protuberance forms a mating location which substantially engages the straight rear part of a corresponding mating contact. Each connector also includes a housing with an insulator having a base and support walls with grooves that each surround the axis of the beam portion of each contact on three sides. The slots between at least some pairs of support walls, closely slidably receive a support wall of the other connector. The length of each contact, in relation to the fundamental frequency of high frequency signals passing through the contacts, is preferably closely controlled to minimize signal degradation. The guiding pins and walls of the pin receiving holes are preferably integrally molded with the support walls that receive the forward contact portions.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A connector system which includes first and second matable connectors, wherein each connector has a housing with an open mating end for mating with the other connector by moving each connector in a corresponding mating direction toward the other connector until said connectors are fully mated, and wherein each connector has a plurality of rows of contacts with each contact including a forward end portion comprising an elongated beam of constant thickness, said beam having a straight rear part extending parallel to said mating direction and having a forward part that is bent to form a protuberance projecting sidewardly, with the extreme side of said protuberance forming a mating location which substantially engages the straight inner part of a corresponding mating contact when said connectors are fully mated, characterized by:

each said connector housing includes an insulator with a wall extending on a side of said beam opposite the direction of projection of said protuberance;

said rear part of each contact extends straight and parallel to said mating direction, said rear part is longer than said forward part, and said forward part has a free tip region which is positioned to engage said wall during mating.

2. The connector system described in claim 1 wherein:

each of said contact forward parts has a tip region extending parallel to said rear part.

3. The connector system described in claim 1 wherein:

each said connector housing includes an insulator with a base and a support wall extending in said mating direction of said base, said support wall having an outside surface and a plurality of elongated grooves in said outside surface with said grooves extending in said mating direction, each groove having a bottom wall and opposite side walls lying about most of said beam;

said rear part of each contact has an outer side lying substantially flush with said support wall outside surface from said base and along said mating direction therefrom.

4. The connector system described in claim 1 wherein:

said wall has an outside surface and a plurality of elongated grooves extending in said mating direction, each groove having a bottom wall portion extending parallel to said beam rear part and positioned to engage said contact free tip region during mating, with each extending largely parallel to said rear part but lying closer to said bottom wall portion than said rear part, to facewise engage said bottom wall during mating.

5. The connector system described in claim 1 wherein:

said first connector housing includes a one-piece molded insulative member forming a base with holes through which said contacts pass and also forming a support wall having a plurality of contact-protecting elongated grooves each extending in said mating direction and largely surrounding one of said beams of a contact lying in a row, said one-piece insulative member also including a locating pin projecting in said mating direction;

said second housing includes a one-piece molded second insulative member forming a base with holes through which said contacts of said second connector pass and also forming a support wall with grooves that largely surround on three sides each of a plurality of contacts that lie in a row, said one-piece member of said second housing having a pin-receiving recess which closely receives said pin prior to mating of said contacts.

6. The connector system described in claim 1 including first, second and third circuit boards lying in parallel planes with each having opposite faces, with said first and second connectors mounted respectively on said first and second boards, wherein:

said second connector has upper and lower connector parts projecting from opposite faces of said second board;

said second board has a plurality of holes and said contacts of said second connector each projects through one of said holes to leave opposite contact end portions extending from the opposite faces of said second board, said opposite end portions being substantially identical with each end portion including an elongated beam having a forward part forming a protubernace.

7. The connector system described in claim 1 including:

a circuit board having a plurality of plated-through holes, said first connector being mounted on said circuit board;

means for generating a plurality of signals and transmitting each signal through a different one of a first plurality of said contacts, with each signal consisting primarily of pulses having a predetermined clock rate R of at least 50 million pulses a second;

each of said first plurality of contacts has a mount part extending through one of said plated holes of said circuit board and each of said forward portions extends from a face of said board by a distance H where $$H = \frac{c \text{ meters/second}}{R \text{ pulses/second}} \times \frac{1}{2^n}$$

wherein R is the clock rate in pulses per second, c is the speed of light, and n is a whole number.

8. The connector system described in claim 7 wherein:

said clock rate is at least $300 \times 10^6$ pulses per second, and said number n is chosen from the group consisting of the numbers 7, 8, 9 and 10.

9. A connector system for connecting first and second circuit boards lying in parallel planes with each having opposite faces and a plurality of holes, comprising:

first and second connectors mounted respectively on said first and second boards;

each said connector comprises a plurality of contacts projecting through said holes in the corresponding board to leave opposite contact end portions substantially extending from said opposite board faces;

both of said opposite contact end portions of the contacts of said second connector and at least the contact end portion projecting from a first face of said second connectors, are substantially identical, with each said identical contact end portion including an elongated beam extending away from a corresponding board face and having a forward part with a mating protuberance projecting largely perpendicular to the length of said beam.

10. The connector system described in claim 9 wherein:

said circuit boards lie closely spaced and in substantially parallel planes, with each of a plurality of contact end portions extending from a first face of said first board being mated with each of a plurality of contacts extending from said first face of said second board;

said first and second connectors each includes an insulator with a base having holes through which a plurality of said contacts extend, with the portion of each contact extending forwardly from said base forming one of said beams;

each of said identical contact end portions is constructed so its beam has a rear part that extends along most of the length of the beam and that extends straight and forwardly from one of said bases up to the beginning of the contact protuberance;

each of said mated contact end portions is positioned with its beam extending substantially parallel to the beam of the mating contact end portion, and with its protuberance substantially engaged with the rear part of the beam of the other contact portion.

11. The connector system described in claim 10 wherein:

each of said insulators includes a support wall having an outside surface and a plurality of grooves extending parallel to said outside surface and in a forward direction away from a corresponding board face, each groove surrounding one of said contact end portions on three sides with one face of each beam rear part lying flush with said outside surface and the opposite face lying within the groove.

12. A module system which includes a mother board having at least one connector and a plurality of modules that can be stacked on said mother board, with each module having a module board with conductive traces that include plated-through holes and a connector that can be mated to a connector of another boards, wherein each connector includes a housing with an insulator having a base with a plurality of rows of base holes and each connector also includes a plurality of rows of contacts with each contact having a mount portion with a part lying in one of said plated-through holes and another part lying in one of said base holes, and with each contact having an elongated beam of uniform thickness and width extending forwardly away from said base, characterized by:

first and second of said connectors each has contacts whose beams have rear parts that extend forwardly and with each beam having a forward part with a sidewardly projecting protrusion and with a tip region furthest from said rear part, said contacts of said first and second connectors being matable to each other;

each of said insulators has a plurality of elongated support walls extending forwardly from said base and extending along one of said rows, with each support wall having a plurality of grooves spaced along one of said rows;

each pair of said support walls being spaced to form a slot therebetween which receives a support wall of the other connector until the tips of each support wall lies adjacent to the base of the other connector insulator, and each said groove extends around the entire length of each beam except for said protrusion.

13. The module system described in claim 12 wherein:

each said beam forward part includes a free tip region furthest from said rear part and lying deeper in said groove than said beam rear part.

14. The module system described in cliam 12 wherein:

each contact has a base-received part lying in interference fit with the walls of one of said base holes.

15. A connector comprising:

a member having opposite faces and forming a plurality of through holes;

a plurality of contacts each having a mount portion mounted in one of said holes and a pair of substantially identical opposite end portions extending in opposite directions from said mount portion;

each contact end portion includes an elongated beam having a straight rear part extending along a predetermined mating direction and having a forward part with a protuberance projecting sidewardly.

16. The connector described in claim 15 wherein:

each said beam rear part extends along most of the length of the beam, and said forward part includes a tip region;

said member includes a wall which lies beside said tip region to engage it when said protuberance is pushed toward said wall during mating of said contact with a contact of another connector.

17. A connector system comprising:

a circuit board having a plurality of plates through holes;

a plurality of contacts each having a mount portion mounted in one of said holes and an elongated end portion projecting substantially perpendicular to said board along a predetermined height H;

a generator for generating pulses having a predetermined clock rate R of at least 50 million pulses per second;

circuitry coupling said generator to each of a first plurality of said contacts to pass pulses of said clock rate R therethrough;

the length H of said end portions of each of said first plurality of contacts is given by the equation:

$$H = \frac{C}{R} \times \frac{1}{2^n}$$

where C is the speed of light, and n is a whole number chosen from the group consisting of the numbers 6, 7 , 8 , 9 and 10.

* * * * *